US012247806B2

(12) United States Patent
Suttles

(10) Patent No.: US 12,247,806 B2
(45) Date of Patent: Mar. 11, 2025

(54) BULLET LOADING TIPS FOR MUZZLELOADING FIREARMS

(71) Applicant: Pacific Northwest Muzzleloader Bullets LLC, Kelso, WA (US)

(72) Inventor: Ryan S Suttles, Kelso, WA (US)

(73) Assignee: Pacific Northwest Muzzleloader Bullets LLC, Kelso, WA (US)

( * ) Notice: Subject to any disclaimer, the term of this patent is extended or adjusted under 35 U.S.C. 154(b) by 0 days.

(21) Appl. No.: 18/787,908

(22) Filed: Jul. 29, 2024

(65) Prior Publication Data

US 2024/0384967 A1 Nov. 21, 2024

(51) Int. Cl.
*F41C 9/08* (2006.01)

(52) U.S. Cl.
CPC ..... *F41C 9/085* (2013.01)

(58) Field of Classification Search
CPC ..... F41C 9/08; F41C 9/085; F41A 29/02
See application file for complete search history.

(56) References Cited

U.S. PATENT DOCUMENTS 17,233 A * 5/1857 Read ..... F41C 9/08 42/51
2,544,150 A * 3/1951 Franklin ..... F41A 29/02 42/95
3,286,293 A * 11/1966 Eckert ..... F41A 29/02 42/95
3,747,252 A * 7/1973 Walker ..... F41C 9/085 42/106
4,327,515 A * 5/1982 Kuryn ..... F41C 9/085 42/90
4,385,546 A * 5/1983 Lee ..... F42B 33/005 86/36
4,399,627 A * 8/1983 Malesky ..... F41A 29/02 42/95
4,536,983 A * 8/1985 Fry ..... F41C 9/085 42/90
4,716,673 A * 1/1988 Williams ..... F41A 29/02 228/115
4,813,169 A * 3/1989 Calliebe ..... F41C 9/085 42/90
4,858,360 A * 8/1989 Hardin ..... F41A 29/02 42/95

(Continued)

OTHER PUBLICATIONS

Hatchet Jack. Rubber Tipped Ramrods. <https://www.modernmuzzleloader.com/threads/rubber-tipped-ramrods.40759/>. Jan. 30, 2022. (Year: 2022).*

*Primary Examiner* — Gabriel J. Klein
(74) *Attorney, Agent, or Firm* — Mohr Intellectual Property Law Solutions, PC

(57) ABSTRACT

Bullet loading tips for muzzleloading firearms. The bullet loading tips include a stem, a platform, and a cushion. The platform is coupled to the stem. The cushion is coupled to the platform. The stem, the platform, and the cushion are complementarily configured with a barrel of the muzzleloading firearm to insert into the barrel with the cushion abutting a bullet disposed in the barrel. The bullet loading tip is configured to press the bullet down the barrel to a seated position at the end of the barrel when the bullet loading tip is urged down the barrel. The bullet loading tip is configured to apply pressure to the bullet in the seated position without deforming the bullet.

4 Claims, 9 Drawing Sheets

(56) References Cited

U.S. PATENT DOCUMENTS

| | | | | | |
|---|---|---|---|---|---|
| 4,875,303 | A * | 10/1989 | DeWeert | F41C 9/085 | 42/90 |
| 4,890,406 | A * | 1/1990 | French | F41C 9/085 | 42/95 |
| 4,974,357 | A * | 12/1990 | Jones | F41C 9/085 | 42/90 |
| 5,016,380 | A * | 5/1991 | Jones | F41A 29/02 | 81/177.4 |
| 5,836,099 | A * | 11/1998 | Pace | F41A 29/02 | 42/95 |
| 5,987,799 | A * | 11/1999 | Dedeaux | F41C 9/085 | 42/90 |
| 6,145,235 | A * | 11/2000 | Emerson | F41C 9/085 | 42/95 |
| 10,429,142 | B1 * | 10/2019 | Rice | F41A 9/83 | |
| 2003/0233779 | A1 * | 12/2003 | Graves | F41A 29/02 | 42/90 |
| 2004/0244260 | A1 * | 12/2004 | Kanyuck | F41C 9/085 | 42/90 |
| 2005/0279003 | A1 * | 12/2005 | Gunn | F41A 29/02 | 42/95 |
| 2006/0048423 | A1 * | 3/2006 | Echeberria | F41C 9/08 | 42/51 |
| 2006/0236853 | A1 * | 10/2006 | Boersching | F41A 3/70 | 89/198 |
| 2013/0061507 | A1 * | 3/2013 | Hunsaker | F41C 9/085 | 42/90 |
| 2013/0104442 | A1 * | 5/2013 | Hancharick | F41C 9/085 | 42/90 |
| 2017/0130799 | A1 * | 5/2017 | Spyche, Jr. | F41A 3/90 | |
| 2019/0331451 | A1 * | 10/2019 | Hunsaker | F41C 9/085 | |
| 2022/0011072 | A1 * | 1/2022 | Minnich | F41C 9/085 | |

* cited by examiner

BULLET LOADING TIPS FOR MUZZLELOADING FIREARMS

BACKGROUND

The present disclosure relates generally to firearm accessories. In particular, bullet loading tips for muzzleloading firearms are described.

Muzzleloading firearms, also known as muzzleloaders, are firearms where a bullet is loaded into a barrel through a muzzle (the front opening) of the firearm rather than through a rear chamber of a firearm. First, a powder charge is poured down the barrel through the muzzle. Next, a ball starter is used to initially push a patch and bullet into the barrel through the muzzle. A short rod of the ball starter is then used to push the patch and bullet a short ways down the barrel. Finally, a longer ramrod is used to push the bullet into a seated position at the rear of the barrel with the powder charge disposed between rear of the barrel and the patch and bullet.

Conventional ball starters and ramrods are prone to damaging the bullet when pushing the bullet in the barrel. Hard contact interfaces between the ball starter or ramrod and the bullet often deform the bullet and degrade its flight characteristics. Degraded flight characteristics cause aim accuracy to suffer.

Some conventional ball starters and ramrods have tips intended to reduce damage to a bullet. However, these conventional tips are typically made from brass and present an undesirably hard contact surface with the bullet. The hard surface of conventional brass tips makes them unsatisfactorily prone to damaging bullets.

It would be desirable to have a bullet loading tip for ball starters and ramrods with a soft contact surface to avoid damaging bullets. Ideally, the bullet loading tip would be configured to be conveniently attached and removed from ball starters and ramrods. It would be advantageous if the bullet loading tip had a contact surface profile that complemented an exterior surface profile of a bullet to spread contact force over a larger area of the bullet and thus reduce contact pressure.

Thus, there exists a need for bullet loading tips that improve upon and advance the design of known bullet loading tips. Examples of new and useful bullet loading tips relevant to the needs existing in the field are discussed below.

SUMMARY

The present disclosure is directed to bullet loading tips for muzzleloading firearms. The bullet loading tips include a stem, a platform, and a cushion. The platform is coupled to the stem. The cushion is coupled to the platform. The stem, the platform, and the cushion are complementarily configured with a barrel of the muzzleloading firearm to insert into the barrel with the cushion abutting a bullet disposed in the barrel. The bullet loading tip is configured to press the bullet down the barrel to a seated position at the end of the barrel when the bullet loading tip is urged down the barrel. The bullet loading tip is configured to apply pressure to the bullet in the seated position without deforming the bullet.

DETAILED DESCRIPTION

Figure 1:
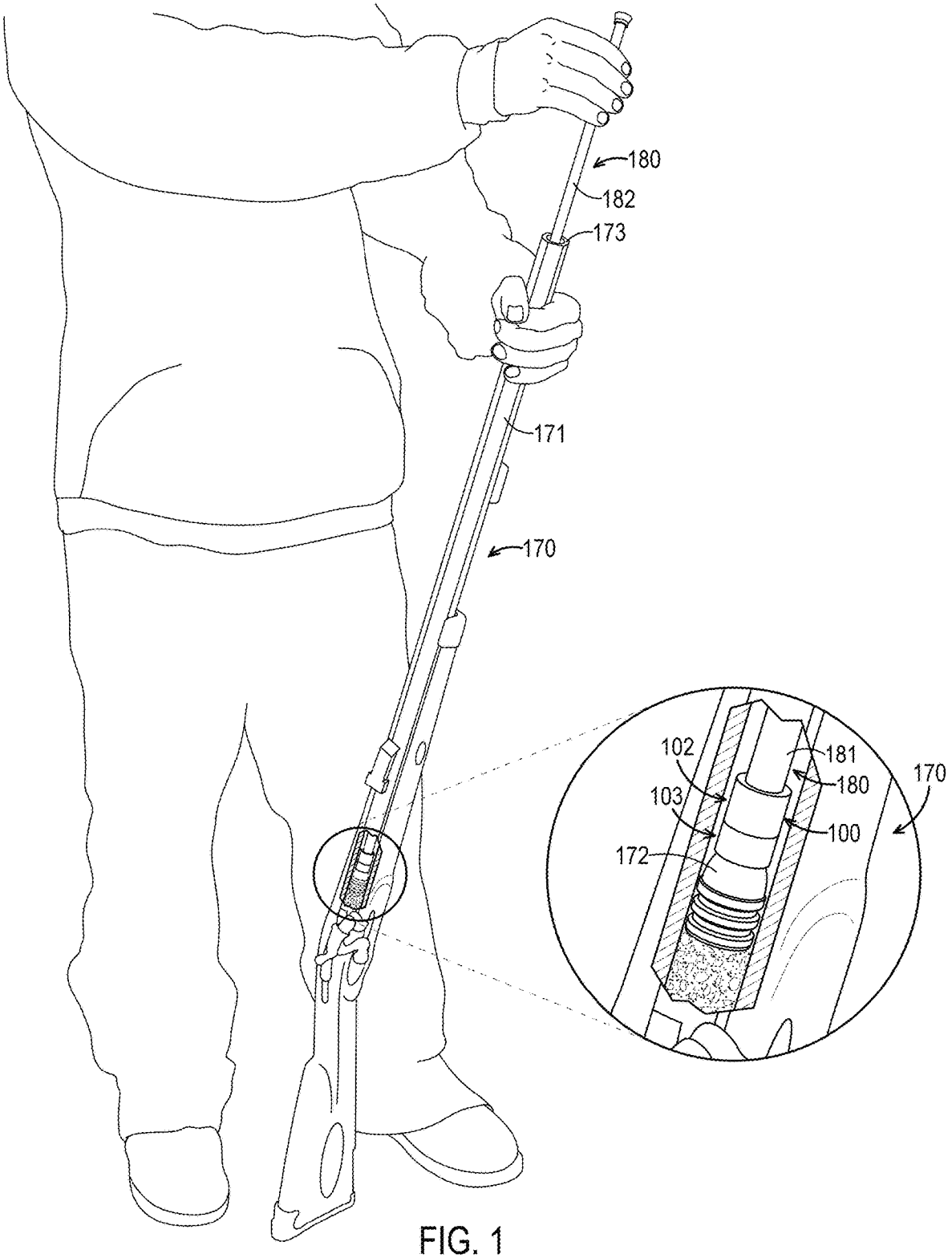
FIG. 1 is a perspective view of a first example of a bullet loading tip mounted on a ramrod and inserted into a barrel of a muzzleloading firearm to press a bullet down the barrel.
Figure 2:
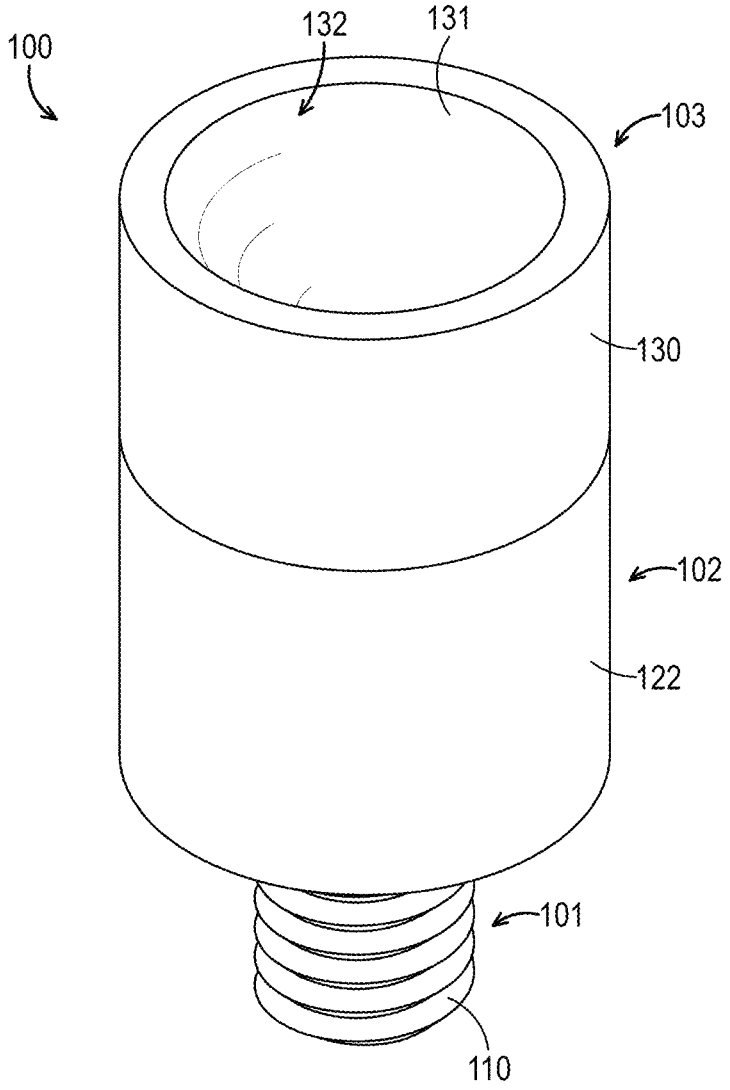
FIG. 2 is top perspective view of the bullet loading tip shown in FIG. 1.
Figure 3:
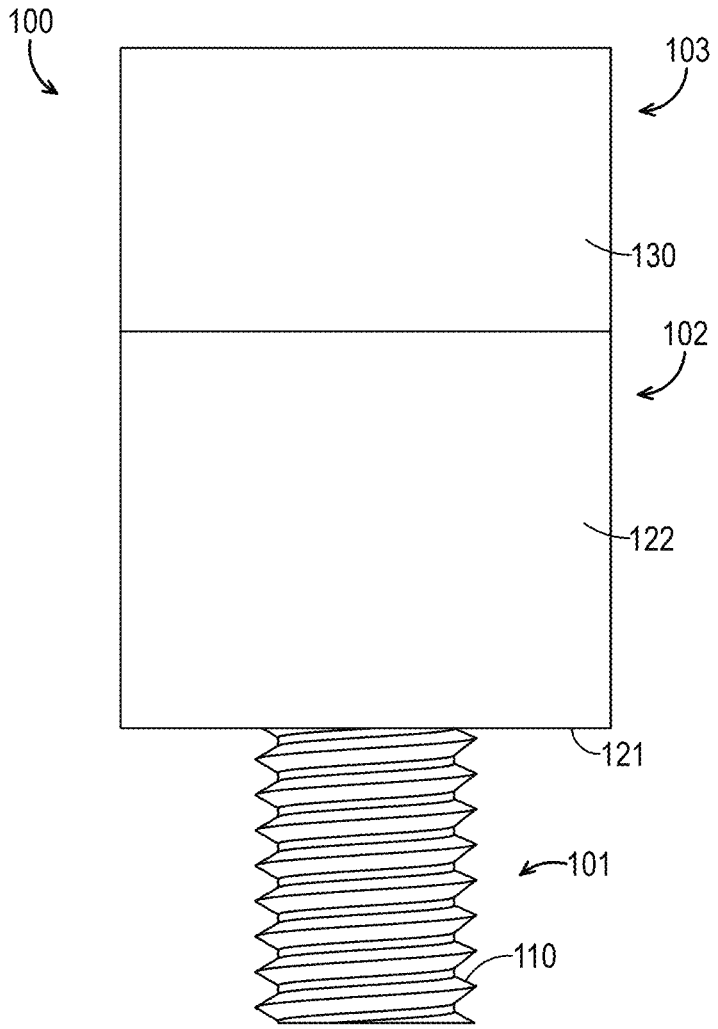
FIG. 3 is a side elevation view of the bullet loading tip shown in FIG. 1.

The disclosed bullet loading tips will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various bullet loading tips are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional elements or method steps not expressly recited.

Terms such as "first", "second", and "third" are used to distinguish or identify various members of a group, or the like, and are not intended to denote a serial, chronological, or numerical limitation.

"Coupled" means connected, either permanently or releasably, whether directly or indirectly through intervening components.

Bullet Loading Tips for Muzzleloading Firearms

With reference to the figures, bullet loading tips for muzzleloading firearms will now be described. The bullet loading tips discussed herein function to urge and seat bullets down barrels of muzzleloading firearms without deforming the bullets.

The reader will appreciate from the figures and description below that the presently disclosed bullet loading tips address many of the shortcomings of conventional bullet loading tips. For example, the novel bullet loading tips enable conventional ball starters and ramrods to be adapted to avoid damaging a bullet when pushing the bullet in a barrel. The novel bullet loading tips do not present hard contact interfaces with the bullet to facilitate pressing on the bullet without damaging the bullet.

As a result of avoiding bullet deformation and damage, the novel bullet loading tips avoid degrading the flight characteristics of bullets. By maintaining the flight characteristics of the bullets, the novel bullet loading tips maintain expected aim accuracy of the bullets.

Unlike conventional bullet loading tips typically made from brass, the novel bullet loading tips do not present an undesirably hard contact surface to the bullet. Instead, the novel bullet loading tips have a soft material that does not damage bullets like often occurs with brass tips.

Desirably, the novel bullet loading tip for ball starters and ramrods have a soft contact surface to avoid damaging bullets. The novel bullet loading tips are configured to be conveniently attached and removed from ball starters and ramrods. Advantageously, the novel bullet loading tips have a contact surface profile that complements an exterior surface profile of a bullet to spread contact force over a larger area of the bullet and thus reduce contact pressure.

Contextual Details

Ancillary features relevant to the bullet loading tips described herein will first be described to provide context and to aid discussing the bullet loading tips.

Firearm

The bullet loading tips described herein are used with firearms. In particular, the bullet loading tips are used with muzzleloading firearms to urge bullets down the barrel of the firearm.

Firearm 170 depicted in FIG. 1 is one example of a suitable muzzleloading firearm. Firearm 170 includes a barrel 171 into which a bullet 172 is inserted. Bullet 172 is inserted into barrel 171 through a muzzle 173 of barrel 171.

The bullet loading tips can be used to load bullets into firearms of various sizes, shapes, styles, and types. The readers should understand that the bullet loading tips described herein may be used to load bullets into any currently known or later developed type of muzzleloading firearm beyond firearm 170 depicted in FIG. 1.

Further, the bullet loading tips may be used with bullets of different sizes, shapes, styles, and types than bullet 172 depicted in FIG. 1. For example, bullet 172 has a conical shape, but other bullets may be round or have different conical shape profiles.

Ramrod

The bullet loading tips described in this document may be selectively mounted to ramrods. As shown in FIG. 1, a ramrod 180 with bullet loading tip 100 mounted to it is used to urge bullet 172 down barrel 171 of firearm 170. Ramrod 180 and bullet loading tip 100 are used to push bullet 172 into a seated position at the rear of barrel 171 with the powder charge disposed between rear of barrel 171 and bullet 172. Ramrod 180 is shown in more detail in FIG. 8.

Figure 7:
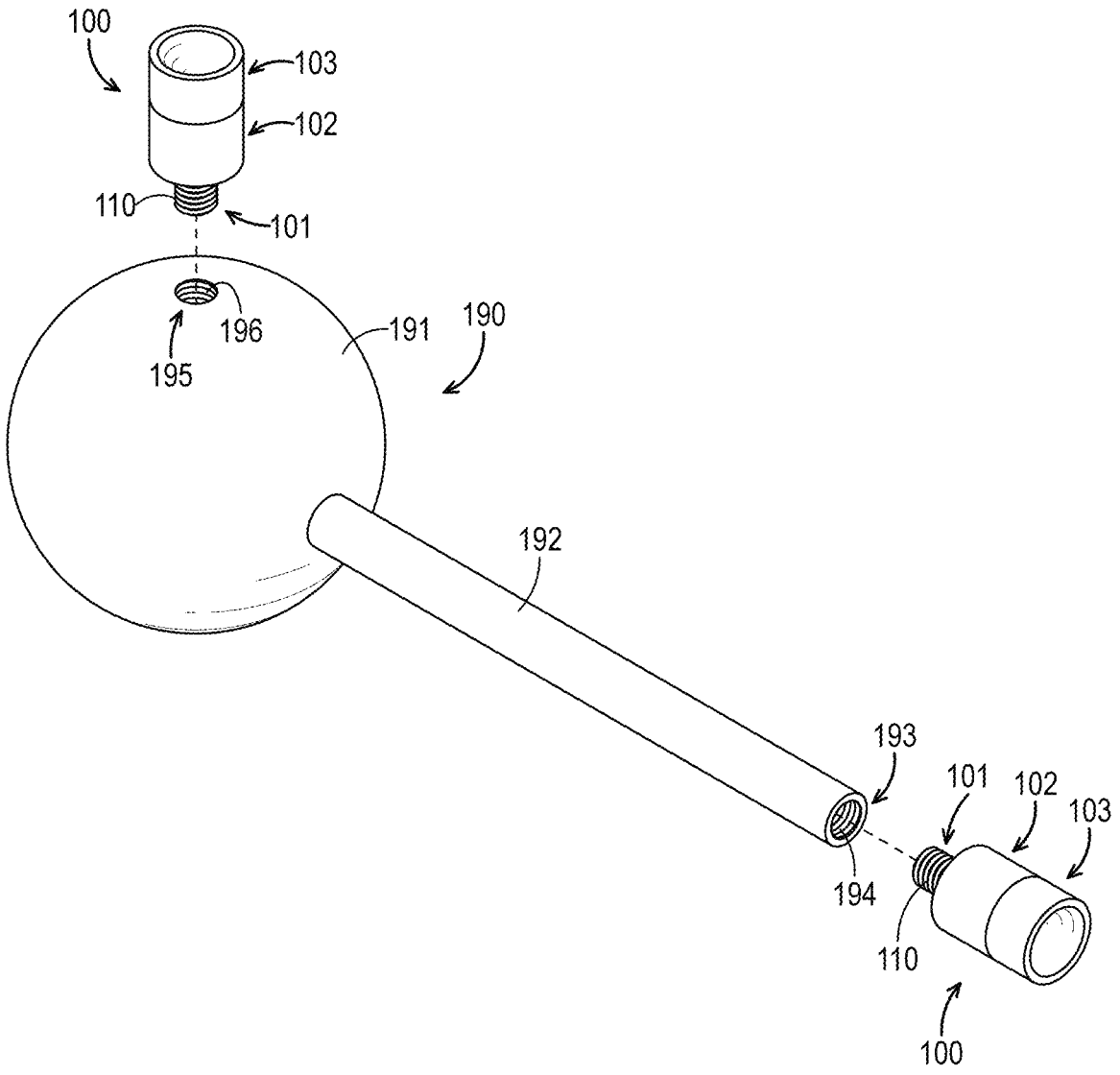
FIG. 7 is a perspective view of the bullet loading tip shown in FIG. 1 ready to be selectively mounted to two locations on a ball starter with threaded sockets complementing a threaded stem of the bullet loading tip.
Figure 8:
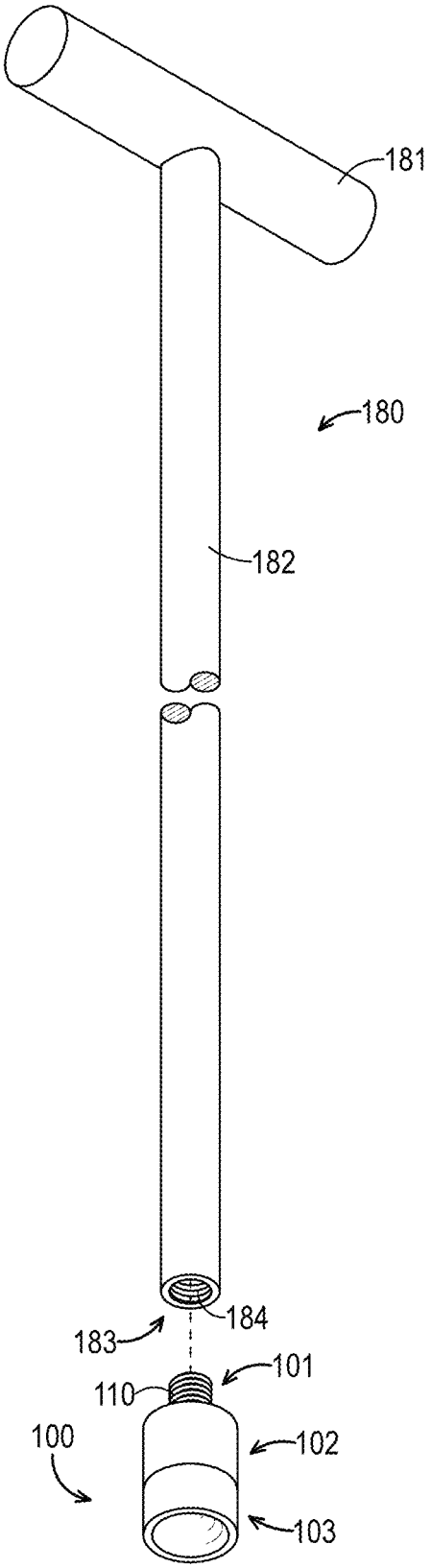
FIG. 8 is a view of the bullet loading tip shown in FIG. 1 ready to be selectively mounted to a ramrod with a threaded socket complementing a threaded stem of the bullet loading tip.

As shown in FIG. 8, ramrod 180 includes a handle 181 and a rod 182. Rod 182 is longer than a corresponding rod 192 of a ball starter 190 shown in FIG. 7. As shown in FIG. 8, rod 182 defines a socket 183 with female threads 184. Bullet loading tip 100 is configured to selectively mount to socket 183.

The size and shape of the ramrod may differ from the example ramrod 180 shown in FIGS. 1 and 8. The style and type of the ramrod may vary as well. The bullet loading tips described in this document may be used with any currently known or later developed type of ramrod for muzzleloading firearms.

Ball Starter

The bullet loading tips described in this document may be selectively mounted to ball starters as well. A ball starter, such as ball starter 190 depicted in FIG. 7, is used to initially push bullet 172 into barrel 171 through muzzle 173. Ball starter 190 is also used to push bullet 172 a short ways down barrel 171 before the longer ramrod 180 is used to push bullet 172 further down barrel 171.

With reference to FIG. 7, the reader can see that ball starter 190 includes a handle 191 and a rod 192. Rod 192 is shorter than rod 182 of a ramrod 180 shown in FIGS. 1 and 8. Rod 192 defines a first socket 193 with female threads 194. Handle 191 defines a second socket 195 with female threads 196. Bullet loading tip 100 is configured to selectively mount to first socket 193 and to second socket 195.

Bullet Loading Tip Embodiment One

With reference to FIGS. 1-8, a first example of a bullet loading tip, bullet loading tip 100, will now be described. Bullet loading tip 100 is configured to press bullet 172 down barrel 171 to a seated position at the end of barrel 171. In particular, bullet loading tip 100 presses bullet 172 down barrel 171 when bullet loading tip 100 is coupled to ramrod 180 or ball starter 190 and urged down barrel 171 by ramrod 180 or ball starter 190. Significantly, bullet loading tip 100 is configured to apply pressure to bullet 172 in the seated position without damaging or deforming bullet 172.

Bullet loading tip 100 includes a stem 101, a platform 102, and a cushion 103. In some examples, the bullet loading tip does not include one or more features included in bullet loading tip 100. In other examples, the bullet loading tip includes additional or alternative features. The components of bullet loading tip 100 are described in the sections below.

With reference to FIGS. 1 and 8, the reader can see that bullet loading tip 100 is configured to selectively mount to rod 182 of ramrod 180. Further, as shown in FIG. 7, bullet loading tip 100 is configured to selectively couple to handle 191 of ball starter 190 or to rod 192 of ball starter 190.

The size and shape of the bullet loading tip may vary in different applications. For example, the size of the bullet loading tip may be selected to correspond with the inner diameter of a barrel. Larger bullet loading tips may be used with larger barrel firearms and vice versa.

Similarly, the shape of the bullet loading tip may complement the shape of a barrel interior. Most barrels are round, but some have regular polygon shapes, such as an octagon. In examples where the barrel is an octagon, the shape of the bullet loading tip may be an octagon as well. The bullet loading tip may be round, a regular polygon, or an irregular shape as appropriate for a given firearm design.

Stem

Stem 101 functions to couple bullet loading tip 100 to a ramrod or to a ball starter. In the example shown in FIGS. 1 and 8, stem 101 enables bullet loading tip 100 to couple to ramrod 180. In the example shown in FIG. 7, stem 101 facilitates bullet loading tip 100 coupling to multiple locations on ball starter 190.

As apparent from FIGS. 2-4, 7, and 8, stem 101 is threaded. In particular, stem 101 defines male threads 110 complementarily configured female threads 184 of socket 183 defined in in ramrod 180. Male threads 110 of stem 101 are also complementarily configured with female threads 194 and 196 of first and second sockets 193 and 195, respectively, defined in ball starter 190.

As shown in FIG. 1, the size of the stem 101 is complementarily configured with barrel 171 of muzzleloading firearm 170. The size and shape of stem 101 enable stem 101 to insert into and move inside barrel 171. The size and shape of the stem may vary in different examples.

Platform

Platform 102 functions to support cushion 103. Platform 102 supports cushion 103 in a position to engage bullet 172 inside barrel 171.

As shown in FIGS. 2-4, 7, and 8, platform 102 is integrally coupled to stem 101. Stem 101 is disposed between ramrod 180 or ball starter 190 and platform 102. Expressed another way, platform 102 is disposed forward of ramrod 180 or ball starter 190 to enable platform 102 and cushion 103 mounted on platform 102 to be inserted into barrel 171 in front of ramrod 180 or ball starter 190.

Figure 4:
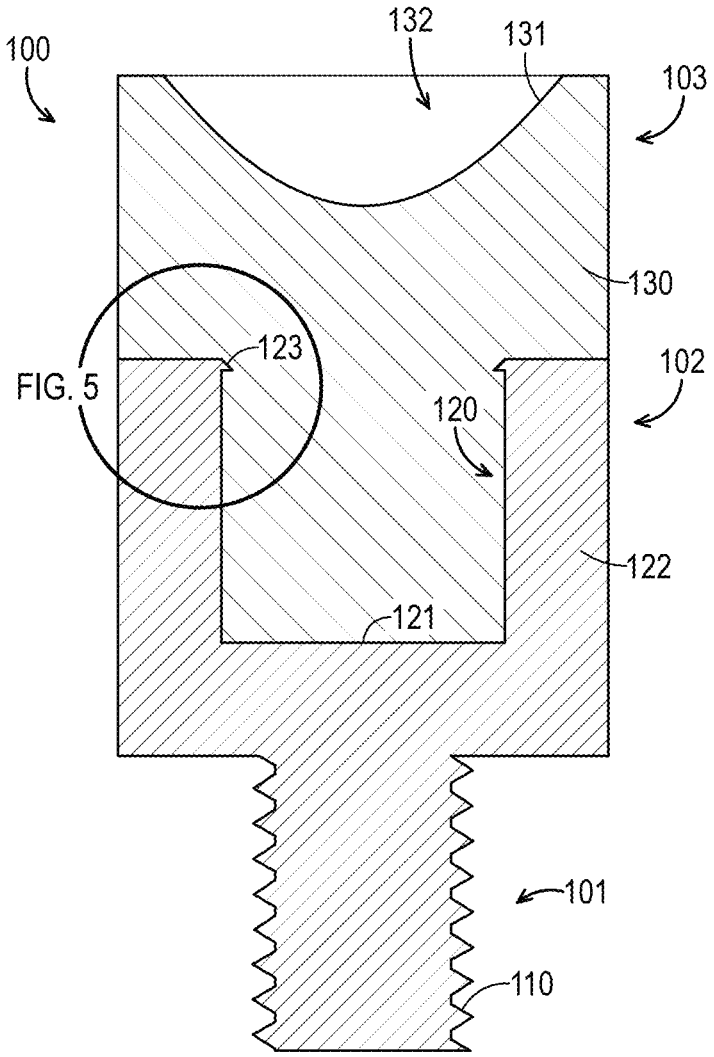
FIG. 4 is a section view of the bullet loading tip shown in FIG. 1.
Figure 5:
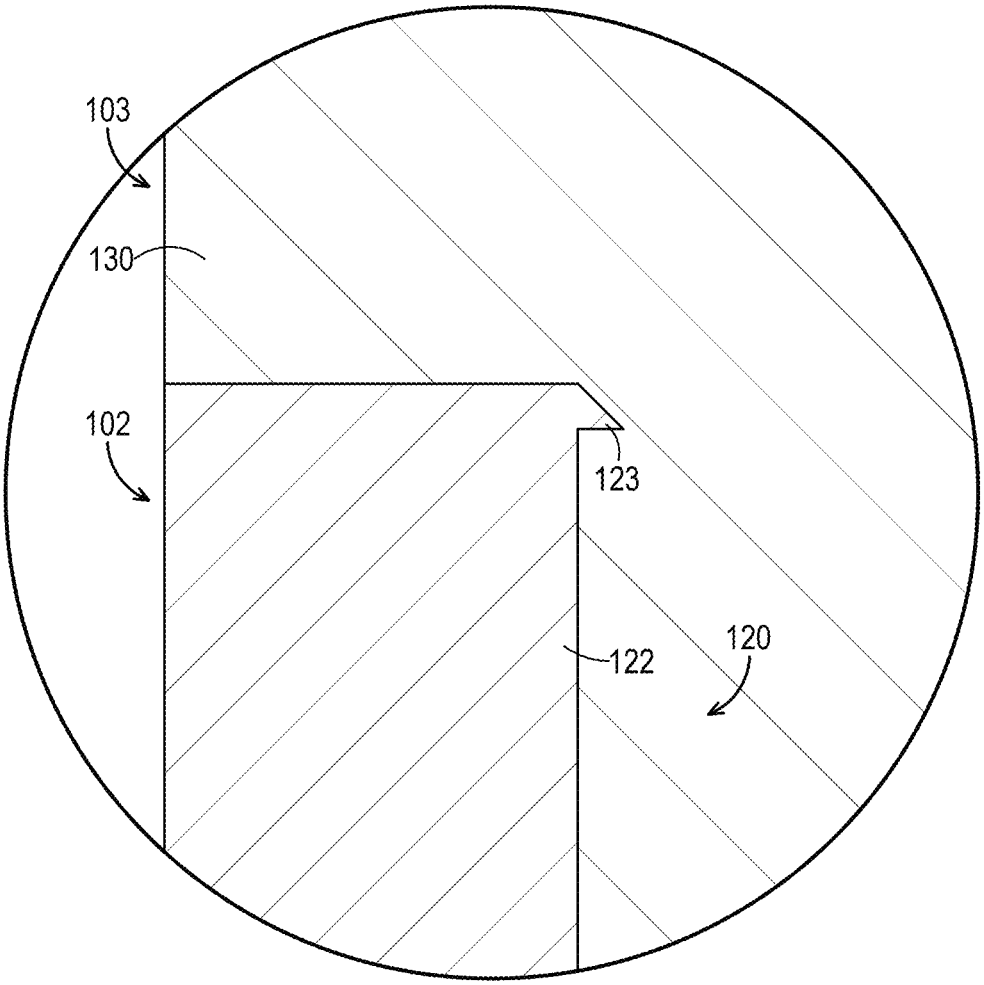
FIG. 5 is a detail view of a spur of the bullet loading tip shown in FIG. 1 corresponding to the circled region depicted in FIG. 4.
Figure 6:
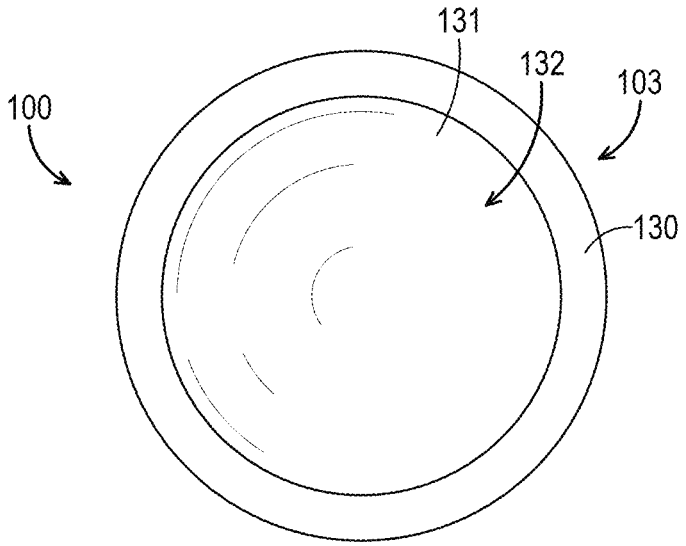
FIG. 6 is a top plan view of the bullet loading tip shown in FIG. 1.

As depicted in FIGS. 4 and 5, platform 102 defines a cup 120 with a floor 121 and sidewalls 122 projecting from a periphery of floor 121. As is apparent from FIGS. 1-4 and 6-8, cup 120 is circular.

As shown in FIGS. 1-8, cushion 103 is supported within cup 120 defined by platform 102. Cushion 103 is received by cup 120 between sidewalls 122 in a position abutting floor 121. Cushion 103 is retained in cup 120 by frictional engagement with sidewalls 122. In certain examples, the cushion is bonded to the platform within the cup with an adhesive.

Figure 9:
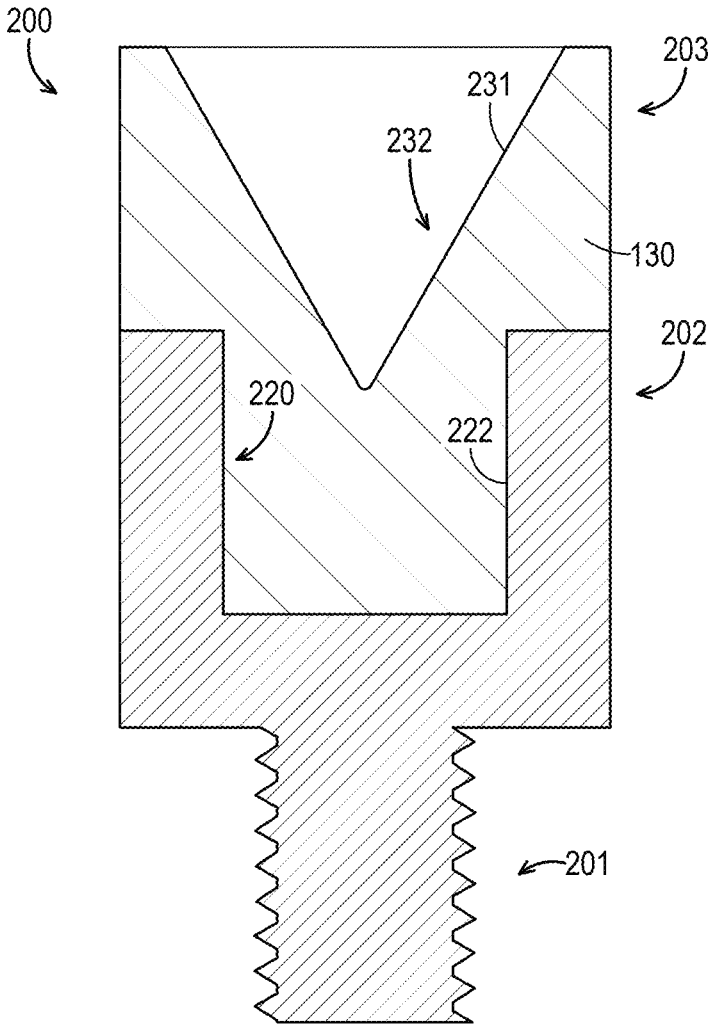
FIG. 9 is a section view of a second embodiment of bullet loading tip.

With reference to FIGS. 4 and 5, the reader can see that sidewalls 122 define a spur 123 projecting towards the center of cup 120. Spur 123 is an optional feature to aid retaining cushion 103 within cup 120, but the spur is not necessary or included in all examples. For example, FIG. 9 depicts a cup 220 without a spur projecting from sidewalls 222. The cup provides sufficient frictional engagement to retain the cushion without the spur feature. The spur is also not necessary in examples where the cushion is adhered to the platform in the cup.

As shown in FIG. 1, the size of the platform 102 is complementarily configured with barrel 171 of muzzleloading firearm 170. For example, the outer diameter of cup 120, defined by floor 121 and sidewalls 122, is less than the inner diameter of barrel 171 to facilitate platform 102 inserting into and moving within barrel 171. The size and shape of platform 102 enable platform 102 to insert into and move inside barrel 171. The size and shape of the platform may vary in different examples, such as when the size and shape of the barrel is different than depicted in FIG. 1.

Cushion

Cushion 103 functions to engage bullet 172 inside barrel 171. In particular, cushion 103 softly engages bullet 172 to avoid damaging bullet 172 as bullet 172 is urged down barrel 171 by ramrod 180 or ball starter 190 coupled to bullet loading tip 100.

As shown in FIGS. 1-8, cushion 103 is coupled to platform 102. Cushion 103 mounts to platform 102 partially within cup 120 forward of stem 101 and extends beyond sidewalls 122. Cushion 103 extending beyond sidewalls 122 on a leading edge of bullet loading tip 100 causes cushion 103 to interface with bullet 172 disposed in barrel 171 when bullet loading tip 100 is inserted into barrel 171 with bullet 172 disposed in barrel 171.

Cushion 103 is configured to redistribute a portion of the compressive force exerted by bullet loading tip 100 on bullet 172 when bullet loading tip 100 and ramrod 180 or ball starter 190 presses on bullet 172 in barrel 171. Cushion 103 redistributing a portion of the compressive force avoids damaging or deforming bullet 172. Cushion 103 includes different features to enable redistributing compressive force on bullet 172.

One force redistributing aspect of cushion 103 is a cushion body 130 formed from a material softer than bullet 172. The comparatively soft material of cushion body 130 absorbs and redirects some of the compressive force. In the present example, cushion body 130 is composed of neoprene. However, other relatively soft materials may be used to form the cushion body as well.

The shape of cushion 103 is another force redistributing feature. As shown in FIGS. 2, 4, and 6-8, cushion 103 includes a leading face 131 defined by cushion body 130. Leading face 131 is disposed proximate bullet 172 when bullet loading tip 100 is inserted into barrel 171.

As apparent in FIGS. 2, 4, and 6-8, leading face 131 defines a concave depression 132. Concave depression 132 is configured to receive a nose of bullet 172. Concave depression 132 is effective to redistribute compressive force from bullet loading tip 100 on bullet 172. In particular, concave depression 132 redistributes compressive force over lateral surfaces of the nose of bullet 172.

As shown in FIG. 1, the size of the cushion 103 is complementarily configured with barrel 171 of muzzleloading firearm 170. The size and shape of cushion 103 enable cushion 103 to insert into and move inside barrel 171 with cushion 103 abutting bullet 172 disposed in barrel 171. The size and shape of the cushion may vary in different examples.

Additional Embodiments

With reference to FIG. 9, the discussion will now focus on an additional bullet loading tip embodiment. The additional embodiment includes many similar or identical features to bullet loading tip 100. Thus, for the sake of brevity, each feature of the additional embodiment below will not be redundantly explained. Rather, key distinctions between the additional embodiment and bullet loading tip 100 will be described in detail and the reader should reference the discussion above for features substantially similar between the different bullet loading tip examples.

Bullet Loading Tip Embodiment Two

Turning attention to FIG. 9, a second example of a bullet loading tip, bullet loading tip 200, will now be described. As can be seen in FIG. 9, bullet loading tip 200 includes a stem 201, a platform 202, and a cushion 203. Distinctions between bullet loading tip 200 and bullet loading tip 100 are described below.

One distinction between bullet loading tip 200 and bullet loading tip 100 is how platform 202 is configured. As shown in FIG. 9, cup 220 does not include an optional spur projecting from sidewalls 222. Cushion 203 is retained in cup 220 without a spur via frictional engagement with sidewalls 222. The cushion could additionally or alternatively be retained within the cup with an adhesive.

Another distinction between bullet loading tip 200 and bullet loading tip 100 is how cushion 203 is configured. As apparent from a comparison of FIGS. 4 and 9, the shape of cushion 203 differs from the shape of cushion 103. Cushion 203 has a leading face 231 that defines a concave depression 232 with a deeper depression than concave depression 132. The tip of concave depression 232 has a slight radius. The shape of cushion 203 increases the contact area for redistributing compressive force on a conical shaped bullet.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A bullet loading tip for a muzzleloading firearm, comprising:

a stem defining threads adapted to selectively couple with corresponding threads defined by one or more of a ball starter and a ramrod;

a platform coupled to the stem, the platform defining a cup with a floor and sidewalls projecting from a periphery of the floor; and a cushion composed of neoprene selected to be softer than a bullet disposed in a barrel of the muzzleloading firearm, the cushion being retained in the cup between the sidewalls in a position abutting the floor and the sidewalls, the cushion defining a concave depression configured to receive a nose of the bullet;

wherein:

the stem, the platform, and the cushion are complementarily configured with the barrel of the muzzleloading firearm to insert into the barrel with the cushion abutting the bullet disposed in the barrel;

the bullet loading tip is configured to press the bullet down the barrel to a seated position at the end of the barrel when the bullet loading tip is urged down the barrel; and the concave depression and the neoprene composition of the cushion cooperate to apply pressure to the bullet in the seated position without deforming the bullet by redistributing compressive force from the bullet loading tip on the bullet over lateral surfaces of the nose of the bullet and by the cushion compressing because it is softer than the bullet to absorb compressive force from the bullet loading tip on the bullet.

2. The bullet loading tip of claim 1, wherein the floor is circular.

3. The bullet loading tip of claim 2, wherein the outer diameter of the floor is less than the inner diameter of the barrel.

4. The bullet loading tip of claim 1, wherein the stem defines male threads complementarily configured with female threads defined in one or more of the ball starter and the ramrod.

* * * * *